US012723399B2

(12) United States Patent
Santana

(10) Patent No.: US 12,723,399 B2
(45) Date of Patent: Sep. 1, 2026

(54) CONCRETE ANCHOR HOLDER

(71) Applicant: Santana Concrete, Riverside, CA (US)

(72) Inventor: Jesse Santana, Riverside, CA (US)

( * ) Notice: Subject to any disclaimer, the term of this patent is extended or adjusted under 35 U.S.C. 154(b) by 122 days.

(21) Appl. No.: 18/818,257

(22) Filed: Aug. 28, 2024

(65) Prior Publication Data

US 2026/0062914 A1 Mar. 5, 2026

(51) Int. Cl.
*E04B 1/41* (2006.01)
*E04B 1/26* (2006.01)

(52) U.S. Cl.
CPC ..... *E04B 1/4157* (2013.01); *E04B 1/2604* (2013.01); *E04B 2001/2684* (2013.01)

(58) Field of Classification Search
CPC ..... E04B 1/4157; E04B 2001/268; E04B 2001/2684; E02D 5/74; E02D 5/76; E04G 21/185
USPC ..... 52/699, 702, 295, 745.21; 249/207
See application file for complete search history.

(56) References Cited

U.S. PATENT DOCUMENTS

D102,576 S 12/1936 Ofeldt
4,413,456 A * 11/1983 Gilb ..... E04B 1/0007 52/295
5,337,534 A * 8/1994 Nasca ..... E04G 21/185 52/699
5,388,804 A 2/1995 Cohen et al.
5,670,076 A * 9/1997 Leek ..... E04G 21/185 52/700
5,702,077 A 12/1997 Heath
7,959,125 B1 6/2011 Coleman
8,672,281 B2 3/2014 Ernst et al.
9,309,683 B1 4/2016 Hurst
9,388,575 B1 7/2016 Gomez
11,680,400 B2 6/2023 Espinosa
2006/0016140 A1* 1/2006 Smith ..... E02D 27/02 52/295
2006/0070312 A1* 4/2006 Fouch ..... E02D 5/74 52/155
2006/0248843 A1 11/2006 Zapata et al.
2022/0403643 A1* 12/2022 Vasavada ..... E04B 1/2612

FOREIGN PATENT DOCUMENTS

WO WO-2019227154 A1 * 12/2019 ..... E04G 21/185

* cited by examiner

*Primary Examiner* — Christine T Cajilig
(74) *Attorney, Agent, or Firm* — Kirk A. Buhler; Buhler & Associates Patenting

(57) ABSTRACT

Improvements in a concrete anchor holder that has an "L" shaped toe that comes down from where an anchor is placed. The toe allows for an offset from the anchor holder to position the anchor a required distance from the batter boards into the area of the foundation where the cement will be poured. The toe includes a plurality of nail holes being level with each other allow for this hanger to be used upside down in an offset condition to suspend the anchor in the foundation/footing above or below the foundation framing boards. The holder includes a window that allows a visual inspection to the form board to allow the user the ability to see where they have marked their hardware prior to the hanging process.

20 Claims, 4 Drawing Sheets

CONCRETE ANCHOR HOLDER

CROSS-REFERENCE TO RELATED APPLICATIONS

Not Applicable.

PRIOR ART

U.S. Pat. No. 11,680,400 issued on Jun. 20, 2023, to Thomas M. Espinosa and is titled Concrete Boss Anchor. This patent discloses an anchor assembly for being embedded in concrete includes a metal plate including an opening, the metal plate including a top surface and bottom surface; the opening including a wall extending from the top surface or the bottom surface; and a threaded anchor operably attached to the metal plate. The anchor system is embedded into concrete and does not hold the anchor on the frame wall where it can be later removed.

U.S. Pat. No. 8,672,281 issued on Mar. 3, 2014, to Richard J. Ernst et al., and is titled Anchor Hanger for Securing a Rod to a Substrate. This patent discloses a anchor hanger for securing a anchor to a substrate includes a mounting portion configured for engaging the substrate, a rod receiving portion configured for receiving the anchor and a connecting element configured for vertically displacing the mounting portion and the anchor receiving portion. In addition, at least one anti-rotation element configured for engaging the substrate is provided on the mounting portion. While this patent discloses a anchor hanger it is not used in concrete foundations and lacks indicia for placement of the anchor.

U.S. Pat. No. 5,702,077 issued on Dec. 12, 1997, to Richard W. Heath and is titled Threaded Bracket for Hanger Anchor. This patent discloses a mounting member for a ceiling or beam utilizes a barrel nut for connection with a hanger anchor of a pipe hanging support. A technique of creating an offset portion about the barrel nut and then deforming that portion to provide secure fixation of the nut in the member to prevent rotation of the nut when the hanger anchor is turned. This patent is for hanging pipes below the ceiling and is not for suspending a anchor when concrete is being poured.

U.S. Pat. No. 9,309,682 issued on Apr. 12, 2016, to Ralph Geald Hurst and is titled Strong Arm Bolt-rebar Hanger System for Concrete Footing Forms. This patent discloses an apparatus with multiple components to create a system capable of holding foundation bolts and foundation rebars prior to pouring concrete. The apparatus consists of [1] A ⅛ inch thick by one inch wide by ten-inch length steel plate bent and twisted in a manner to hold both bolt and rebars. [2] A square steel tube one inch by one inch by one inch with ⅛ inch wide by ½ inch deep notch to be used in conjunction with above mentioned strong arm. [3] A ⅛ inch thick by one inch wide by seven-inch length steel plate with the top portion bent over one inch with a ⅝ inch hole to accommodate a foundation bolt and two ⅝ inch notches to hold top and bottom rebar. [4] A ⅛ inch by 20-inch steel anchor bent in a described manner to hang the top and bottom rebars from above-described strong arm. While this patent discloses a holding apparatus for holding foundation bolts it is not can't be installed in different positions or have markings for different frame boards.

What is needed is a concrete anchor holder that includes a grasping cam that can be positioned in a tree with an adjustable fulcrum to pull seed pods from palms or other plants. The concrete anchor holder disclosed in this document provides the solution.

BACKGROUND OF THE INVENTION

In areas where buildings are subject to abnormal stresses such as earthquakes, tornadoes, and hurricanes can occur it is important that the structure of the house is secured to the foundation to prevent movement of the structure (usually wood) from sliding or moving off the cement foundation or piers. Current building codes in these areas require casting anchor bolts in the cement foundation. The positioning is made prior to pouring the foundation with holder that are positioned and secured to the batter boards or foundation footing boards or foundation wall. These boards can be 2×4 or 2×6 inch width depending upon the span and amount of cement that is being poured. These boards and the holder(s) are removed after the cement has sufficiently cured or hardened.

SUMMARY OF THE INVENTION

It is an object of the concrete anchor holder to include an "L" shaped toe that comes down from where an anchor is placed. The toe allows for an offset from the anchor holder to position the anchor a required distance from the batter boards into the area where the cement will be poured.

It is an object of the concrete anchor holder for the toe to have a plurality of nail holes that are Level with each other allow for this hanger to be used upside down in an offset condition and maintain the anchor upright while the cement is being poured and is hardening.

It is another object of the concrete anchor holder for the L Shaped toe that comes down from where the anchor is placed. The toe as well as the nail holes being Level with each other allow for this hanger to be used upside down in an offset condition to suspend the anchor in the foundation/footing.

It is another object of the concrete anchor holder to include the ability of this hanger to be hung in place during concrete pouring without the need of removing the concrete anchor holder during the pouring process.

It is still another object of the concrete anchor holder to include a window that allows a visual inspection of the form board to allow the user the ability to see where they have marked their hardware prior to the hanging process.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
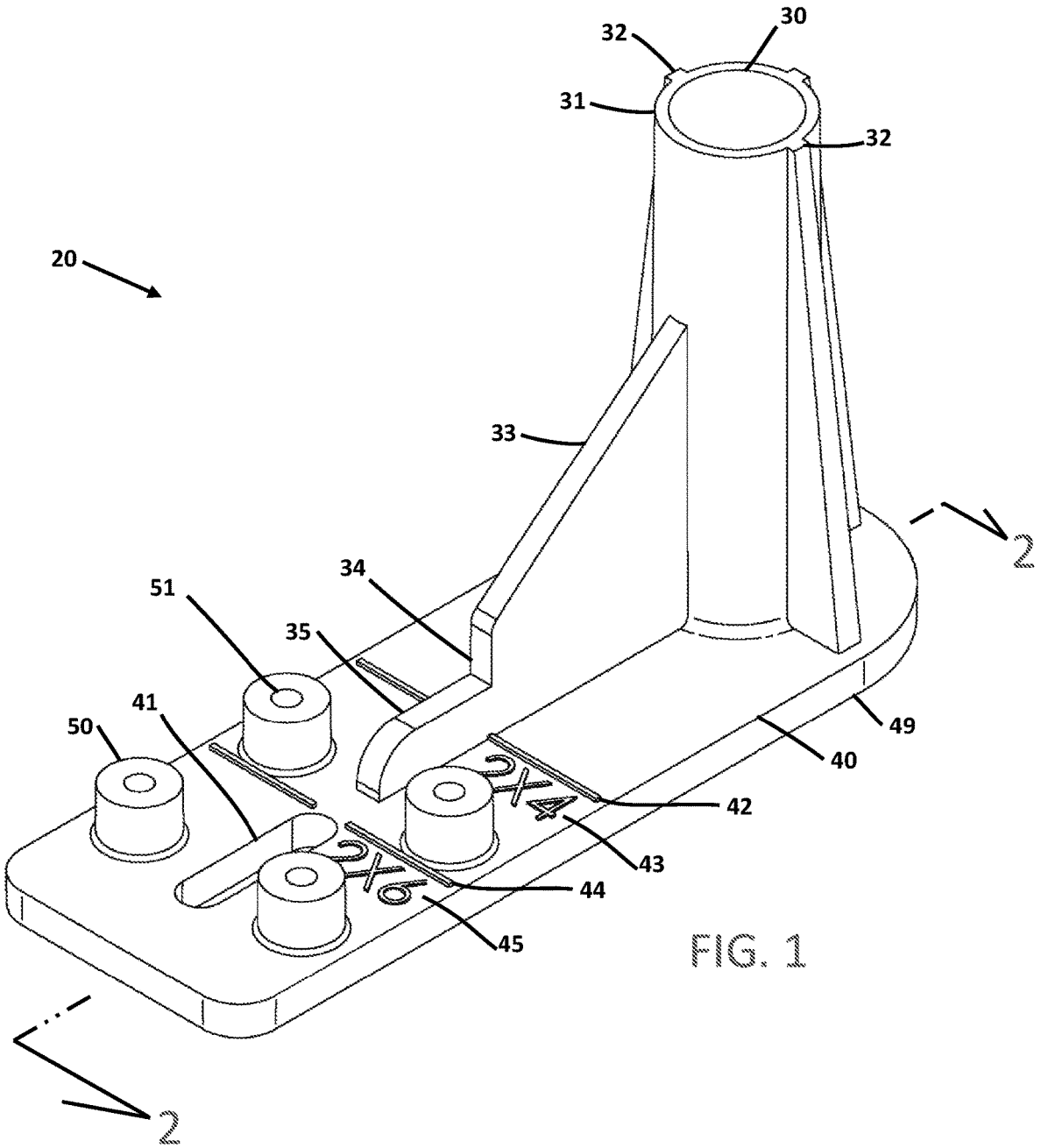
FIG. 1 shows a perspective view of a concrete anchor holder.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof. It will be understood that like or analogous elements and/or components, referred to herein, may be identified throughout the drawings with like reference characters.

Item Numbers and Description

| | |
|---|---|
| 15 threaded end | 16 anchor threaded end |
| 17 anchor for concrete foundations | 18 nail(s) |
| 19 threaded cap | 20 concrete anchor holder |
| 30 anchor hole | 31 anchor boss |
| 32 rib | 33 rib |
| 34 edge | 35 toe |
| 40 top | 41 window |
| 42 line indicia | 43 2 × 4 indicia |
| 44 line indicia | 45 2 × 6 indicia |
| 46 recess indicia | 49 bottom |
| 50 boss | 51 nail hole |
| 52 through hole | 60 threaded nut/cap |
| 61 threads | 62 shoulder |
| 63 side tab | 90 offset dimension |
| 91 hole radius | 92 center |
| 93 line | 94 framing lumber |
| 95 height | |

FIG. 1 shows a perspective view of a concrete anchor holder 20. The concrete anchor holder 20 is designed to hold an anchor (not shown in this figure) through the anchor hole 30 while concrete is being poured and hardens. The hole 30 is within an anchor boss 31 with structural supporting ribs 32. The diameter of the anchor hole 30 is preferably sized to accept an anchor with a diameter of ⅝ inch or ⅞ inch but it is contemplated that the concrete anchor holder 20 can be equivalently designed to accept anchor anchors with a diameter of ⅜-inch, ½-inch, ¾-inch, 1-inch or larger or smaller English or Metric size anchors.

The concrete anchor holder 20 has a bottom 49 that is perpendicular to the anchor hole 30 with a top surface 40. A plurality of bosses 50 with nail holes 51 extend parallel with the anchor hole 30. The nail holes 51 are configured to hold the concrete anchor holder 20 on forming lumber (not shown in this figure). The top of the bosses 50 exist at a height parallel with a toe 35. The toe terminates at edge 34 that is parallel with the anchor hole 30 and provides a desired offset from edge 34 to the center of the anchor hole 30. A rib 33 joins the toe 35 and the edge 34 to the outside of the anchor boss 31.

A window 41 passes through the top 40 to the bottom 49 of the concrete anchor holder 20. Window 41 is used to align the center of the concrete anchor holder 20 to the center of the anchor hole 30. The top 40 surface of the concrete anchor holder 20 is shown with line indicia 42 and 44 along with 2×4 indicia 43 and 2×6 indicia 45 for positioning of the concrete anchor holder 20 on their respective board dimensions. In the preferred embodiment the concrete anchor holder 20 is fabricated from a plastic injection molded material, but other materials and manufacturing process are contemplated. A cross-section line is shown in this view for reference to the cross-section view shown in other view(s) herein.

Figure 2:
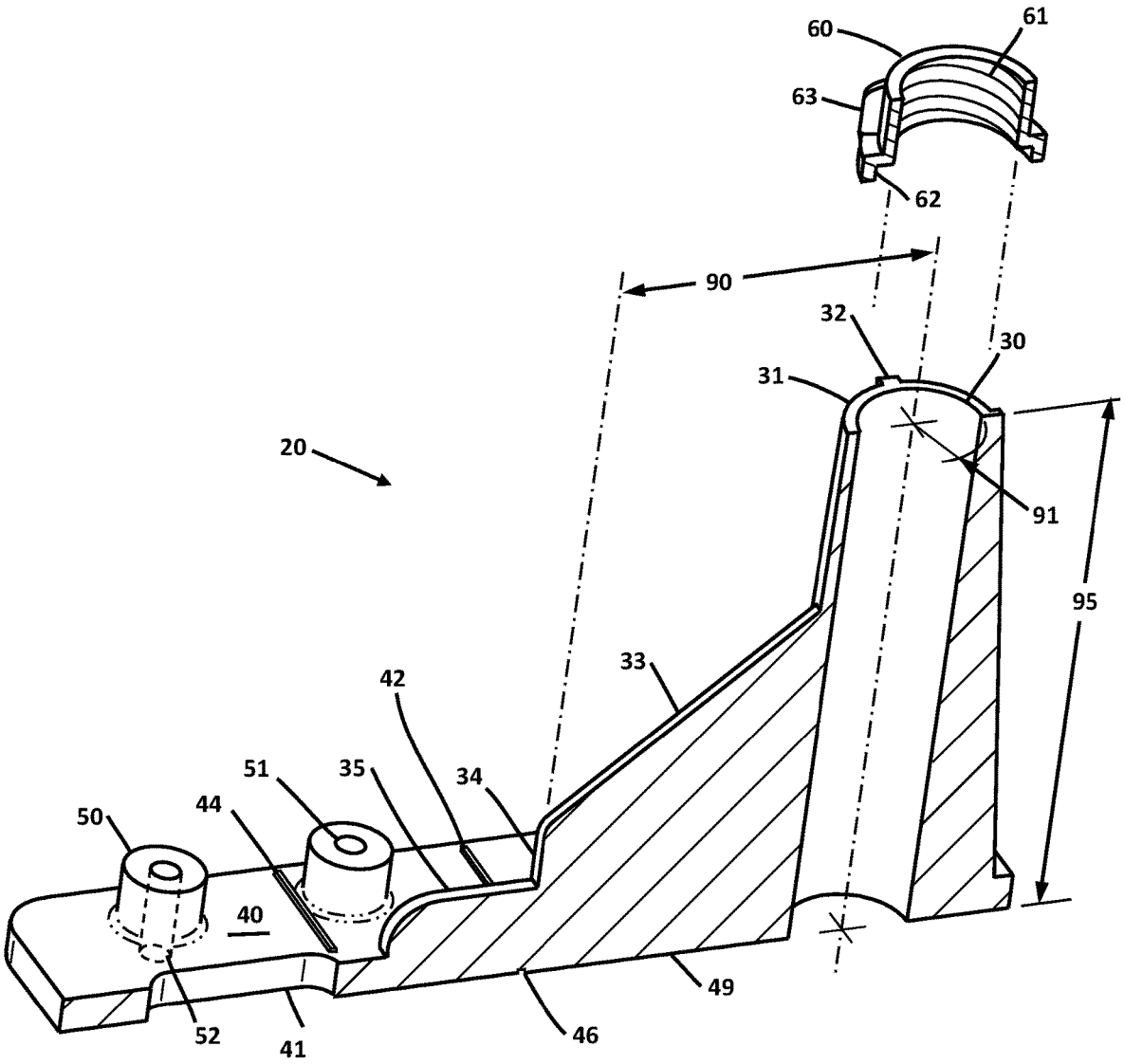
FIG. 2 shows a cross-sectional view of the concrete anchor holder taken from section 2-2 in FIG. 1.

FIG. 2 shows a cross-sectional view of the concrete anchor holder 20 taken from section 2-2 in FIG. 1. This figure shows that a number of features are aligned in the essentially symmetric configuration of the concrete anchor holder 20. Specifically, anchor hole 30 is aligned with the edge 34 of the toe 35, that is aligned with the center of the window slot 41. This allows an installer to place the anchor (not shown in this figure) in a position with a marking on the form board that that is visible through window 41. In the preferred embodiment window 41 is formed as an elongated elliptical shape, but could take any shape from a circle, arrow, diamond, square or rectangle.

The toe 43 is "L" shaped and comes down from where the concrete anchor holder 20 is placed. This toe 43 as well as the nail holes 51 are being level with each other allow for the concrete anchor holder 20 to be used upside down in an offset condition. The shifting of the nail holes 51 also allows the ability of the concrete anchor holder 20 to be hung in place during concrete pours without the need of removing the concrete anchor holder 20 during the pouring process.

The anchor hole 30 is shown with a hole radius 91 that is sized based upon the diameter of the anchor (not shown). The dimension of radius 91 provides a slight clearance for the anchor to maintain the anchor in a concentric relationship to the anchor hole 30. None, one or a plurality of structural rib(s) 32 provide a connection between the outer diameter of the anchor boss 31 and the top 40 of the concrete anchor holder 20. This figure shows an offset dimension 90 between the centerline of the anchor hole 30 and the edge 34 of the toe 35. Rib 33 provides secure structure between the edge 34 and the anchor boss 31. The edge 34 is placed on the inner edge of a forming board (not shown) at a desired dimension to place the center of the anchor hole 30, and an anchor, into the foundation. The overall height of 90 of the concrete anchor holder 20 is preferably 3 inches thereby allowing the concrete anchor holder 20 to be used with bolts in the exterior and interior "flipped" orientation.

The concrete anchor holder 20 is secured to forming boards with fasteners placed through the through holes 52 of hole(s) 50 and into the forming boards. The top of boss(es) 50 are at the same height as the top of the toe 35. Some indicia lines 42 and 44 are shown extending above the top 40 of the concrete holder 20. The indicia line 46 is shown as a recess into the bottom 49. Both raised and recessed indicia is contemplated based upon the design. The recessed indicia 46 is used in the bottom 49 of the concrete anchor holder 20 so the bottom surface is flat.

This figure further includes a threaded nut/cap 60 in the cross-section. While a custom cap is shown and described the threaded nut/cap 60 could be a standard nut for the anchor. The threaded nut/cap 60 threads onto the anchor (not shown) to suspend the anchor in the form. In this preferred embodiment the threaded nut/cap 60 has an internal thread 61 that matches the thread diameter and pitch of the anchor. The threaded nut/cap 60 has an offset shoulder 62 that clears the outer edge of rib(s) 32 to provide a seal on the concrete anchor holder 20. The threaded nut/cap 60 further shows one or a plurality of side tab(s) 63 that provide a grip to the threaded cap 60 that can be articulated by an installer wearing gloves or the like.

Figure 3A:
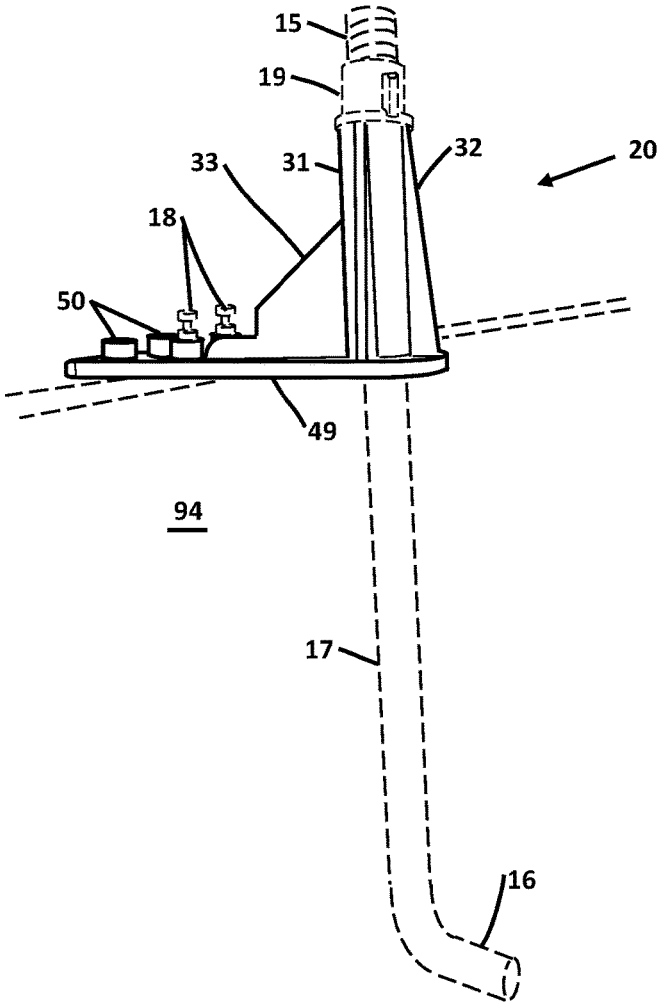
FIGS. 3A-3B shows the concrete anchor holder in an environment of use hung upright in FIG. 3A and upside-down in FIG. 3B.
Figure 3B:
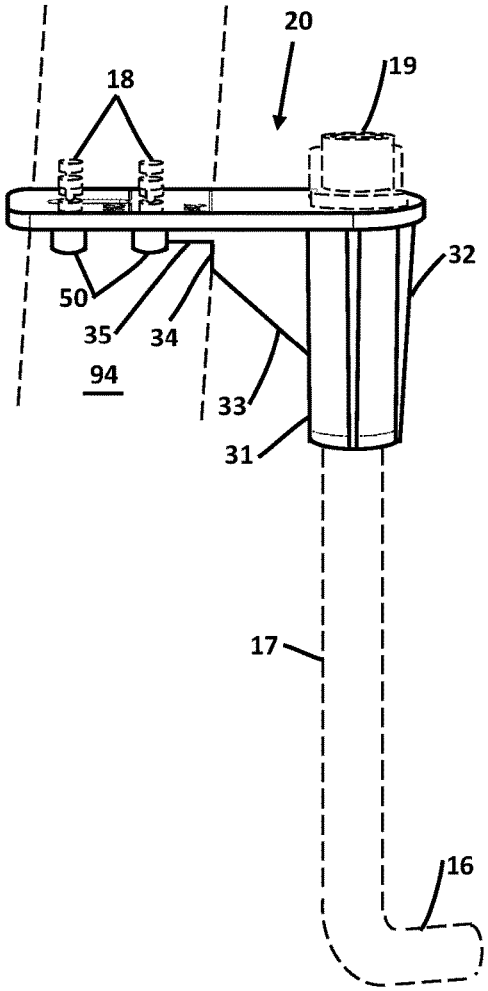

FIGS. 3A-3B shows the concrete anchor holder 20 in an environment of use hung upright in FIG. 3A and upside-down in FIG. 3B. In both figures the anchor for concrete foundations 17 is shown in the concrete anchor holder 20. The anchor 17 is typically configured with an "L" bend 16. While the "L" bend 16 is most commonly used there are other configurations with "S" bends, "T" or plates welded to the anchor for concrete foundations 17. The anchor for concrete foundations 17 is retained in vertical position within the anchor boss 31 and the vertical displacement of the "L" bend 16 can be controlled by threading the threaded cap 19 onto the threaded end 15 in FIG. 3A a portion of the threaded end 15 is shown extending above the threaded cap 19.

In FIG. 3A the bottom 49 of the concrete anchor holder 20 is nailed against the framing lumber 94 with nails 18 through the holes in bosses 50. In FIG. 3B the concrete anchor holder 20 is inverted, and the edge 34 of the toe 35 on rib 33 is against the side of the framing lumber 94. The concrete anchor holder 20 in FIG. 3B is secured to the framing lumber 94 with nails 18 passing through the holes in bosses 50. Structural/strengthening ribs 32 maintain the perpendicular alignment of the anchor for concrete foundations 17 with the bottom 49 or the bosses and toe 35, depending upon the orientation of the concrete anchor holder 20.

The concrete anchor holder 20 has a planar surface 40 with an offset perpendicular anchor boss 31 that extends there through. The planar surface 40 has a plurality of elevated bosses 50 for temporally securing the concrete anchor holder 20 on a framing lumber 94. The planar surface 40 further includes a rib centered 33 that connects to the perpendicular anchor boss 31. Rib 33 includes a toe 35 with a vertical edge 34 that is parallel to the anchor boss 31 and at a displaced distance from a center of the anchor boss 31 as shown in previous figures. The top of the toe 35 is at a height that is parallel to a top of the elevated bosses 50.

The concrete anchor holder 20 has a cylindrical anchor boss 31 with a through hole 30 is secured to a planar base 40. The cylindrical anchor boss 31 being perpendicular to the planar base 40. The cylindrical anchor boss 31 further includes at least one rib 33 that connects to the planar base 40. There is a plurality of holes 51 for temporally securing the concrete anchor holder 20 on a framing lumber 94 with fasteners 18. At least one rib 33 includes a toe 35 with a vertical edge 34 that is parallel to the perpendicular anchor boss 31 and at a distance from a center of the perpendicular anchor boss 31. The top of the toe 35 is at a height that is parallel to the plurality of fastener holes 51.

Figure 4:
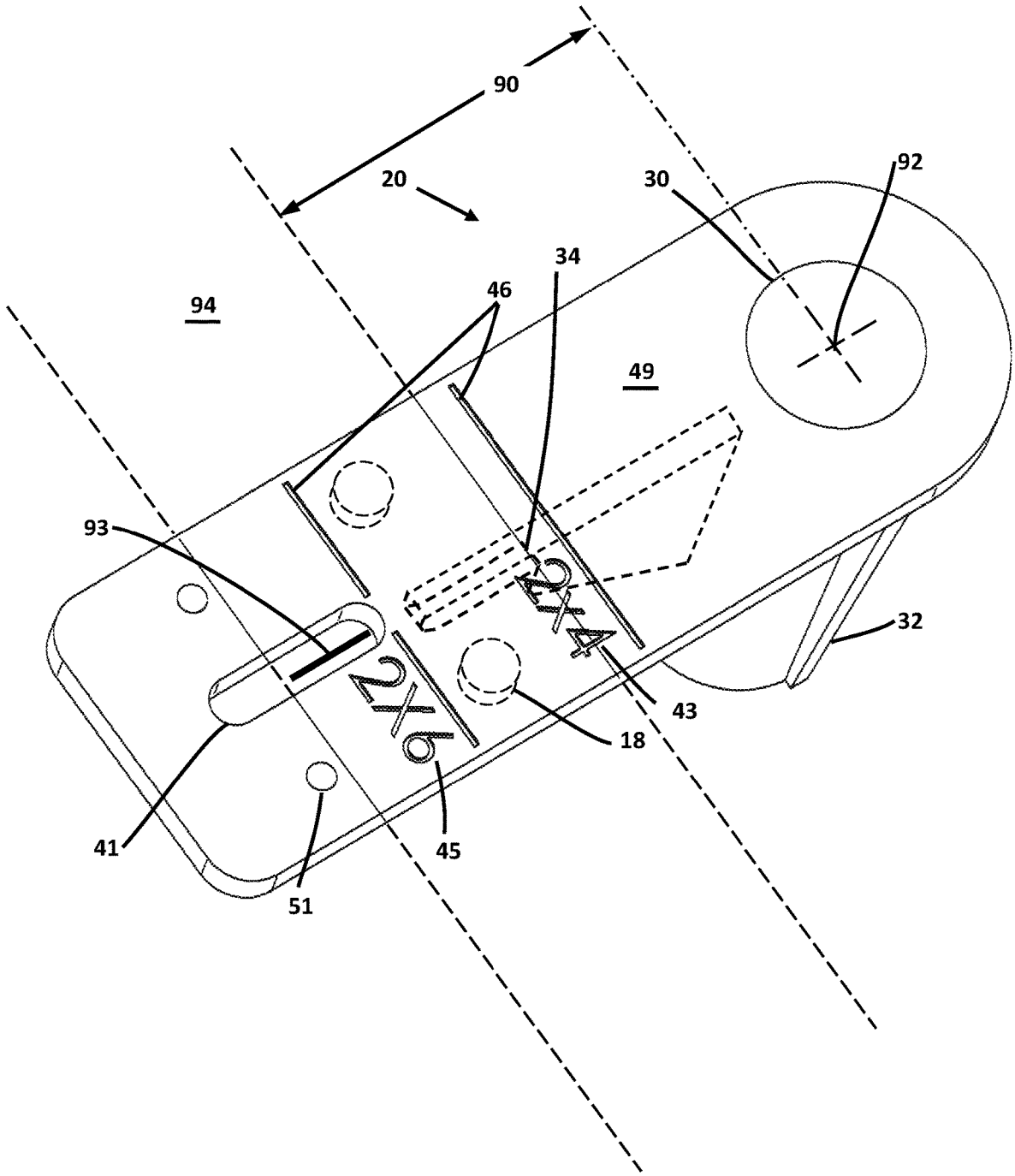
FIG. 4 shows a perspective view of the concrete anchor holder showing locating the concrete anchor holder on using the window.

FIG. 4 shows a perspective view of the concrete anchor holder 20 showing locating the concrete anchor holder 20 using window 41. The window 41 also allows a visual to the form board to allow the user the ability to see where they have marked their wood forming hardware prior to the hanging process. This figure shows how the concrete anchor holder 20 would appear looking down on the concrete anchor holder 20 as it is secured onto the framing lumber 94 with nails 18 securing the concrete anchor holder 20 to the framing lumber 94 through hole(s) 51. This figure shows the offset dimension 90 between the edge 34 of the nose step and the center 92 of the anchor hole 30. One of the stiffening ribs 32 is shown extending down into the view. It is contemplated that this dimension can be set based upon the plans or the diameter of the anchor (not shown).

When the foundation is being framed the location of the anchor(s) is often marked on the framing lumber 94 with a line 93 or other indicia. The concrete anchor holder 20 has window 41 whereby line 93 can be viewed through the concrete anchor holder 20 to ensure proper alignment of the concrete anchor holder 20 in the foundation. The concrete anchor holder 20 also includes raised or recessed marking indicia for alignment on a 2×4 43, 2×6 45 with indicia lines 46. Parallax in this view from the thickness of the concrete anchor holder 20 shows an offset of the edge of the framing lumber 94 and the toe edge 34 from the bottom 49 of the concrete anchor holder 20 to the top of the framing lumber 94.

Thus, specific embodiments of a concrete anchor holder have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A concrete anchor holder comprising:

a planar surface having an offset perpendicular anchor boss that extends there through;

said planar surface having a plurality of elevated bosses for temporally securing said concrete anchor holder on a framing lumber;

said planar surface further includes a rib centered on said planar surface that connects to said perpendicular anchor boss;

said rib includes a toe with a vertical edge that is located to align with an edge of at least one of a 2×4 and a 2×6 framing lumber;

said vertical edge being parallel to said perpendicular anchor boss and at a displaced distance from a center of said offset perpendicular anchor boss, and a top of said toe is at a height that is parallel to a top of said elevated bosses.

2. The concrete anchor holder according to claim 1, further includes an elongated through window in said planar surface that is in linear elongated alignment with said perpendicular anchor boss and between said plurality of elevated bosses.

3. The concrete anchor holder according to claim 2 wherein said concrete anchor holder is configured for securing on said framing lumber in an upright or inverted orientation with fasteners passing through said elevated bosses.

4. The concrete anchor holder according to claim 1, further includes indicia.

5. The concrete anchor holder according to claim 4, wherein said indicia includes positioning information for securing said concrete anchor holder on at least one of a 2×4 and a 2×6 lumber.

6. The concrete anchor holder according to claim 5, wherein there are separate said elevated bosses for said 2×4 and said 2×6 lumber markings.

7. The concrete anchor holder according to claim 1, wherein said concrete anchor holder is fabricated from a plastic material.

8. The concrete anchor holder according to claim 1, wherein further includes an anchor boss that is sized to accept one of a ⅜-inch, a ½-inch, a ⅝-inch, a ¾ inch, a ⅞ inch or a 1-inch anchor.

9. The concrete anchor holder according to claim 1, wherein said anchor boss is sized to accept an anchor that is a diameter other than a ⅜-inch, a ½-inch, a ⅝-inch, a ¾ inch, a ⅞ inch or a 1-inch anchor.

10. A concrete anchor holder comprising:

a cylindrical anchor boss secured to a planar base;

said cylindrical anchor boss having a through hole;

said cylindrical anchor boss being perpendicular to said planar base;

said cylindrical anchor boss further includes at least one rib that connects to said planar base;

said planar base having a plurality of fastener holes for temporally securing said concrete anchor holder on a framing lumber;

said at least one rib includes a toe with a vertical edge that is located to align with an edge of at least one of a 2×4 and a 2×6 framing lumber;

said vertical edge being parallel to said cylindrical anchor boss and at a displaced offset distance from a center of said cylindrical anchor boss, and a top of said toe is at a height that is parallel to said plurality of fastener holes.

11. The concrete anchor holder according to claim 10, further includes an elongated through window in said planar surface that is in linear elongated alignment with said perpendicular anchor boss and between said plurality of elevated bosses.

12. The concrete anchor holder according to claim 11 wherein said concrete anchor holder is configured for securing on said framing lumber in an upright or inverted orientation with fasteners passing through said fastener holes.

13. The concrete anchor holder according to claim 10, further includes indicia.

14. The concrete anchor holder according to claim 13, wherein said indicia includes positioning information for securing said concrete anchor holder on at least one of a 2×4 and a 2×6 lumber.

15. The concrete anchor holder according to claim 14, wherein there are separate said fastener holes for said 2×4 and said 2×6 lumber markings.

16. The concrete anchor holder according to claim 10, wherein said concrete anchor holder is fabricated from a plastic material.

17. The concrete anchor holder according to claim 10, wherein said anchor boss is sized to accept one of a ⅜-inch, a ½-inch, a ⅝-inch, a ¾ inch, a ⅞ inch or a 1-inch anchor.

18. The concrete anchor holder according to claim 10, wherein said anchor boss is sized to accept an anchor that is a diameter other than a ⅜-inch, a ½-inch, a ⅝-inch, a ¾ inch, a ⅞ inch or a 1-inch anchor.

19. The concrete anchor holder according to claim 1, wherein said toe is at a height that is parallel to a height of said anchor bosses.

20. The concrete anchor holder according to claim 10, wherein said toe is at a height that is parallel to a height of said anchor bosses.

* * * * *